United States Patent [19]

Seragnoli

[11] 4,395,177

[45] Jul. 26, 1983

[54] APPARATUS FOR FEEDING FOLDED AND FLATTENED CARTONS TO A PACKAGING MACHINE

[75] Inventor: Enzo Seragnoli, Bologna, Italy

[73] Assignee: G. D Societá per Azioni, Bologna, Italy

[21] Appl. No.: 257,357

[22] Filed: Apr. 24, 1981

[30] Foreign Application Priority Data

May 15, 1980 [IT] Italy ..... 3425 A/80

[51] Int. Cl.[3] ..... B65G 59/06; B65H 3/24; B65H 5/02

[52] U.S. Cl. ..... 414/130; 198/409; 271/10; 271/35; 271/225; 414/125

[58] Field of Search ..... 271/35, 225, 10, 12, 271/13, 271, 184, 185, 6, 7, 165, 166, 269; 198/409, 407; 414/125, 128, 130, 131; 53/566, 207

[56] References Cited

U.S. PATENT DOCUMENTS

| | | | |
|---|---|---|---|
| 2,402,048 | 6/1946 | Hyde et al. | 414/131 X |
| 2,554,577 | 5/1951 | Lauffer | 271/10 X |
| 2,697,528 | 12/1954 | Bishop et al. | 414/130 X |

FOREIGN PATENT DOCUMENTS

| | | | |
|---|---|---|---|
| 494507 | 7/1950 | Belgium | 271/35 |

*Primary Examiner*—Bruce H. Stoner, Jr.
*Attorney, Agent, or Firm*—Fitzpatrick, Cella, Harper & Scinto

[57] ABSTRACT

The apparatus comprises a continuous path, divided into a first rising section and a second substantially horizontal section, having a conveyor extending there along and carrying one or more pushers adapted to withdraw individually folded and flattened cartons from a container magazine provided and arranged at the top of the rising section. At the junction location between the two sections, movable supports are provided which receive, when at a first position arranged in continuation of the rising section, individually folded and flattened cartons and transfers the latter, when arranged at a second position in which said supports are arranged parallel to the conveying along the substantially horizontal section, again on the conveyor without said cartons being left by the one or more pushers. This assures a correct arrangement of said cartons on said conveyor downstream of the junction location.

10 Claims, 6 Drawing Figures

APPARATUS FOR FEEDING FOLDED AND FLATTENED CARTONS TO A PACKAGING MACHINE

BACKGROUND OF THE INVENTION

This invention relates to an improved apparatus for feeding folded and flattened cartons to a packaging machine.

More particularly, this invention is concerned with an improved apparatus for individually removing folded and flattened cartons from the bottom outlet opening of a magazine containing a heap of such cartons for feeding the latter to a conventional packaging machine, along which operating stations are provided for developing the individual cartons into parallelepiped form, filling the cartons with the desired product, closing the cartons after filling up operation and discharging the filled up and closed cartons from the packaging machine.

The raw material for the cartons is generally a preformed corrugated paper board having cut out parts and folding lines, so that it can be developed into the parallelepiped form of a box, and generally such cartons are supplied by manufactures in heavy stacks tied up with metal straps or the like.

The loading operation of heavy stacks into the magazine of the feeding apparatus, where said magazine has the upper loading opening at a relatively high level with respect to the ground floor, is laborious and time consuming, and accordingly it is advisable to maintain said loading opening as low as possible.

However, the packaging machine associated with the carton feeding apparatus may have the packaging line, i.e. the various operating stations at a higher level than at least the outlet opening of the magazine, and should be supplied, as in the case of cigarette packaging machines, with folded and flattened cartons along a substantially horizontal path.

As far as the applicant knows, the conventional packaging machines are provided with a substantially horizontal straight packaging line, or said packaging line is inclined as shown, for example, in FIG. 1 of U.S. Pat. No. 3,063,209, according to which the angular position of the packaging line has been selected to supply by simple gravity cans or similar rollable articles to the machine.

The teachings provided by said U.S. Pat. No. 3,063,209, although indirectly maintaining at least the outlet opening of the magazine for the folded and flattened cartons at a lower level than the packaging line, do not deal with the problem of horizontally feeding said cartons, i.e. maintaining such cartons correctly positioned should, for technical requirements, an initially rising and then horizontal path be required.

Thus, where at least the initial portion of the packaging line should be substantially horizontal and at least the magazine outlet opening should be at a lower level than said packaging line, the correct transfer of the cartons from the rising section to the horizontal section of the path would not occur, since at the junction location of the two sections, each carton would first advance in a slant attitude and cantilevered arrangement until its center line is downstream relative to the carton advancement direction, and would then fall down onto the horizontal section with resulting disengagement from the pushing means and possible incorrect arrangement of the carton on the horizontal section.

SUMMARY OF THE INVENTION

It is the object of the present invention to provide an improved apparatus for allowing the correct supply of folded and flattened cartons to a packaging machine having a substantially horizontally extending packaging line and at a higher level than the level of at least the discharge or unloading opening of the carton containing magazine.

This and further objects, which will become apparent to those skilled in the art, are accomplished by an improved apparatus for feeding folded and flattened cartons to a packaging machine the apparatus is of the type comprising a continuous path formed of a first rising section and a second substantially horizontal section, the end portion of which is associated with or is part of a packaging line of said packaging machine, conveyor means movable in a single forward direction along said continuous path, pusher means carried by said conveyor means, and a magazine for containing said folded and flattened cartons, having an upper loading opening and a lower outlet opening and overlying said rising section, characterized in that at the junction zone between said first and second sections of the path movable supporting means for the cartons are provided, with said supporting means oscillating between a first position arranged in continuation of said first rising section and a second position, wherein said supporting means are arranged substantially coplanar and parallel to said conveyor means along said second substantially horizontal section, and actuating means for said supporting means in synchronism with said conveyor means.

The novel features which are considered as characteristic of the invention are set forth in particular in the appended claims. The improved apparatus itself, however, both as its construction and its mode of operation, together with additional features and advantages thereof, will be best understood upon perusal of the following detailed description of a specific embodiment with reference to the accompanying drawings.

DESCRIPTION OF THE PREFERRED EMBODIMENT

Referring to the accompanying drawings, the apparatus is conventionally carried by a framework 1 (partially shown by dashed lines in FIG. 1) and substantially comprises a magazine 2 for holding a heap of folded and flattened cartons 4 and a path 3 for the successive transfer of individual cartons 4 from said magazine to a packaging machine.

Figure 1:
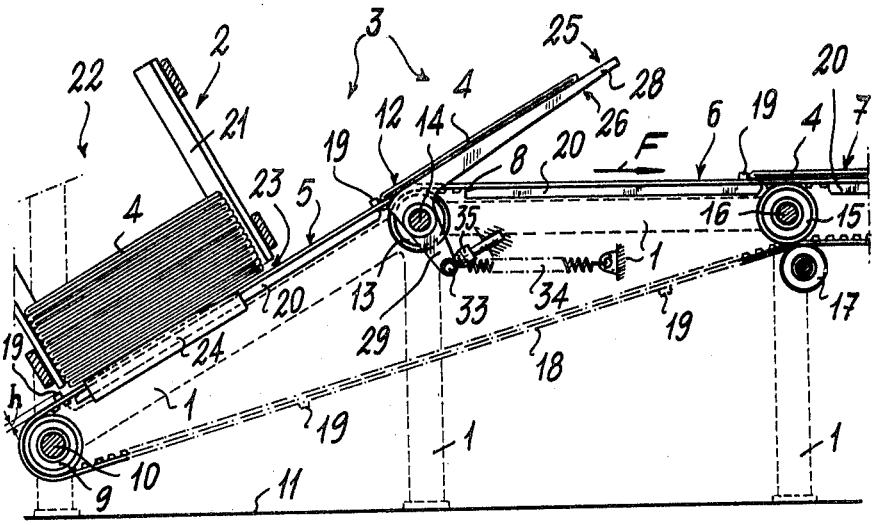
FIG. 1 is a schematic side view of the improved apparatus as a whole with the carton supporting elements at a first position.

As shown in FIG. 1, the path 3 comprises a first rising section 5 and a second horizontal section 6, the latter forming the initial part of a packaging line 7, partly shown and per se known of a packaging machine not forming part of the present invention.

The path 3 is defined by a pair of ring-entrained, continuous toothed belts 8, parallel arranged and controlled or driven to move in the direction of arrow F by a first pair of sprockets 9 keyed on a drive shaft 10 carried by said framework 1 adjacent the ground 11.

At the junction location or zone 12 between the rising section 5 and the horizontal section 6 a further pair of sprockets 13 are provided as idly mounted on a shaft 14, the latter being also carried by said framework 1 parallel to shaft 10, but at a higher level than the latter.

Depending on the length of the horizontal section 6, a further pair of sprockets 15 may be mounted on a horizontal shaft 16, carried by said framework 1 parallel to and at the same level as shaft 14.

A pair of pusher rollers 17 maintain the lower runs 18 of belts 8 in engagement with said rollers or sprockets 15.

Of course, said rollers or sprockets 15 may form the transmission for the continuous belts 8, and the pusher rollers 17 may be dispensed with should the packaging line 7 be provided independently and arranged in continuation of the horizontal section 6.

Figure 3:
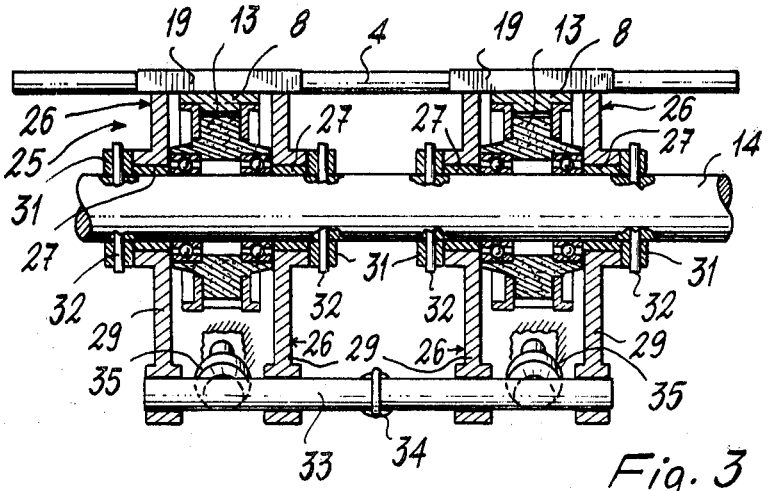
FIG. 3 is a cross-sectional view of the apparatus taken alone line III—III of FIG. 2.
Figure 4:
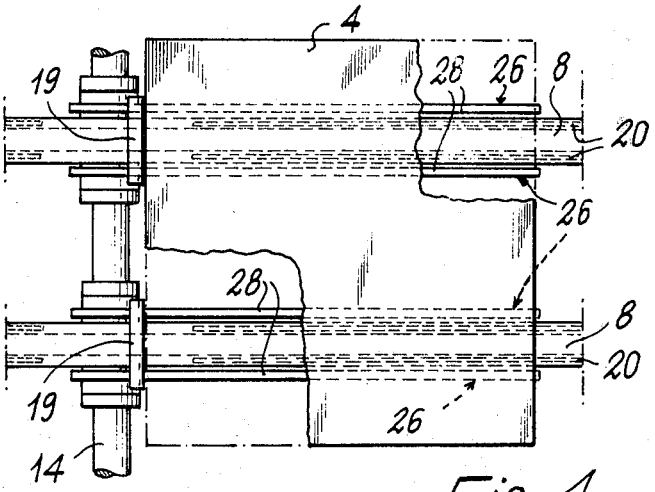
FIG. 4 is a plan view of the portion of the apparatus shown in FIG. 2.

On the upper face, that is opposite to the toothings of each belt 8, a plurality of pusher elements 19 are transversely arranged and evenly spaced apart along the entire development in longitudinal direction of said belts 8, with the elements 19 of one belt being arranged side by side to the elements 19 of the other belt to form pairs of elements, each element being in the form of a bar projecting from both sides of the respective belt, as shown in FIGS. 3 and 4.

As particularly shown in FIG. 1, each element 19 has a height h substantially corresponding to the thickness of a folded and flattened carton 4, and at the bottom of said belts 8, along said sections 5, 6 and 7, guiding and supporting bars 20 are provided and secured to the framework 1.

The magazine 2 is supported by the framework 1, inclined relative to the vertical, at a position overlying said rising section 5. Said magazine is of conventional structure and substantially comprises a framework 21 adapted to be adjusted depending on the size of the folded and flattened cartons 4 therein stacked, defining an upper loading opening 22 and a lower outlet opening 23, the dimensions of the latter being such as to allow the passage of the pusher elements 19 below said magazine 2.

The heap of cartons 4 is supported within the magazine 2 by a pair of elongated elements 24, parallel to the belts 8 and secured to the framework 1 so as to support the first carton in the heap just above said belts 8, but at a lower level than the height h of the above mentioned pusher elements 19.

As more clearly shown in FIG. 3, movable supporting means are provided at said junction zone 12 and comprise an oscillating support, generally denoted at 25.

Said oscillating support 25 comprises four bell-crank elements 26, two by two arranged at the sides of each sprocket 13, pivoted to said shaft 14 through the interposition of bushings 27. Each of the bell-crank elements 26 are formed of a main or upper arm 28 and a secondary or lower arm 29, the latter downward extending and connected to arms 28 by a curved length 30 (FIG. 2) having center of curvature on the axis of said shaft 14.

As shown in FIG. 4, each pair of main arms 28 arranged at the sides of a sprocket 13 develops or extends in the forward moving direction F of belts 8.

Additionally, the arms 28 of said pair of arms are arranged parallel to each other and are spaced apart by a slightly larger length than the width of the belt 8 therebetween.

Figure 2:
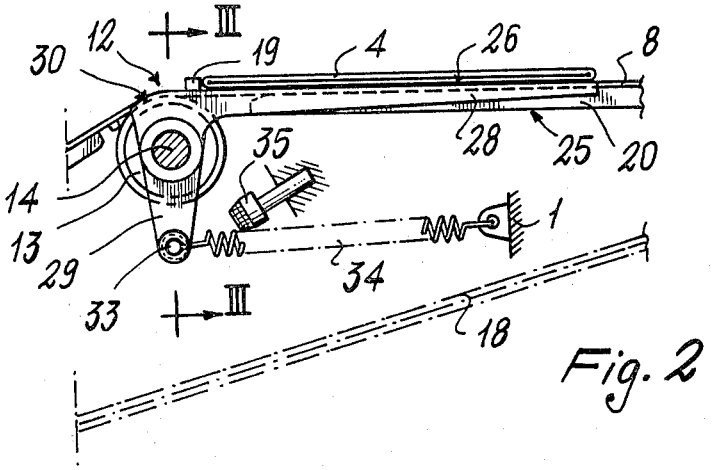
FIG. 2 is a schematic side view of the junction location between the first rising section and the second horizontal section with the carton supporting elements at a second position.

The shaft 14 traverses the secondary arms 29 of said bell-crank elements 26 at a distance from the upper surface of the curved length 30 slightly larger than the radius of said sprockets 13, so that the upper surface of the main arms 28 can be flush or arranged substantially flush with the upper surface of said belts 8, when the oscillating support 25 is at the clockwise oscillated position shown in FIG. 2.

The sidewise displacement of the bell-crank elements 26 is inhibited by ring elements 31 secured by means of pins 32 to said shaft 14. The end portions of the secondary arms 29, opposite to the curved length 30, are engaged by a common pin 33 parallel to the shaft 14, to the central part of which a traction spring 34 is secured by one end, the other end of said spring being secured to said framework 1.

Two stop plugs 35, carried by the framework 1, are placed along the arc of circle path followed by said pin 33 as the latter moves from the position shown in FIG. 2 to the position shown in FIG. 1, as described in the following.

In operation, a pair of pusher elements 19 engage the rear side of the lowest carton 4 in the heap and urges it, by passing through the outlet opening 23 of magazine 2, along the rising section 5 and along and above the arms 28 of the bell-crank elements 26, now at the upward oscillated position and in continuation of the rising section 5, shown in FIG. 1, through the action of spring 34 and inhibited to pass said position by the stop plugs 35 engaging said pin 33.

On continued forward movement, the laterally projecting parts of the element 19 pass over the curved lengths 30 of the bell-crank elements 26 and engage the upper surfaces of the main arms 28 and, while sliding above and along said surfaces, cause a downward oscillation of the elements 26, against the action of spring 34, from the position shown in FIG. 1 to the position shown in FIG. 2, where each of the elements 26 skirt on two sides the respective belt 8, with the upper surface flush with the flat upper surface of said respective belt. The carton 4, now supported by both the main arms 28 and belts 8, due to the continuous and uninterrupted pushing effect of elements 19, leaves said arms 28 and continues along the horizontal section 6, thus reaching the packaging line 7 without any change in the orientation thereof.

As soon as the projecting parts of elements 19 double the bell-crank element 26, the latter again oscillate upward due to the action of spring 34.

From the foregoing it clearly appears that the primary feature of the invention consists of the provision of oscillating supporting means 25 at the junction zone 12, said means being adapted for smooth passage of the individual cartons 4 from the inclined position taken along the rising section 5 to a horizontal position, where said cartons are at a planar attitude on the belts 8 along said section 6, and thus maintaining the correct position taken at the outlet opening 23 of the magazine and without being ever left by the pusher elements 19.

Figure 5:
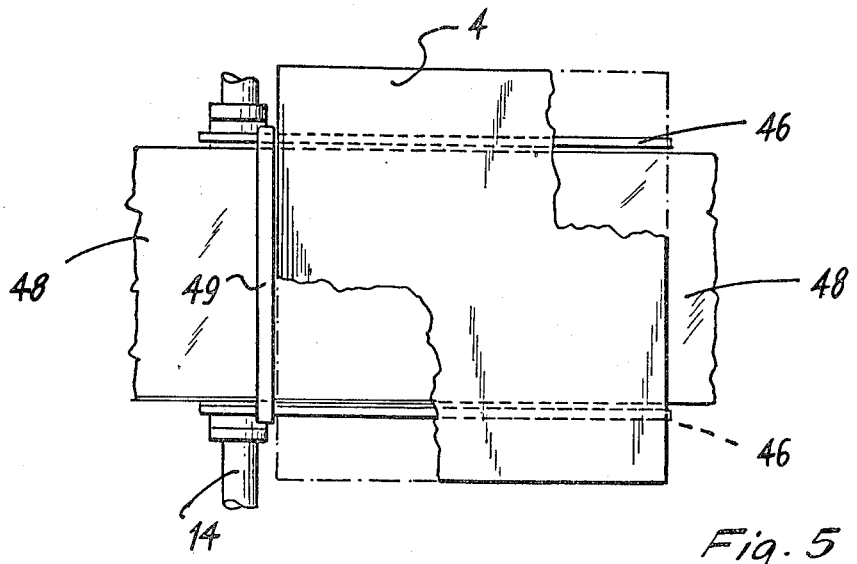
FIG. 5 is a plan view of another embodiment of the belt means of the apparatus shown in FIG. 1.
Figure 6:
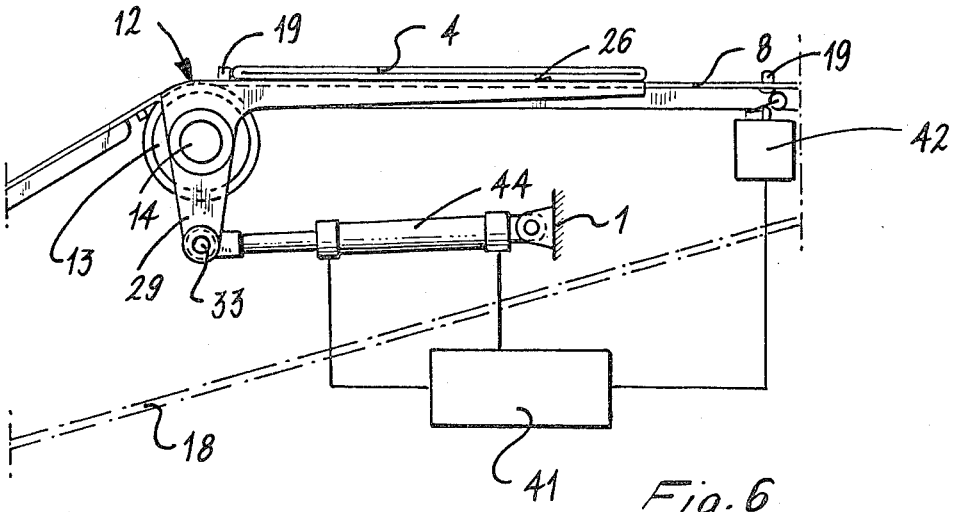
FIG. 6 is a schematic side view of another embodiment of the junction location shown in FIG. 1.

In another embodiment shown in FIG. 5, the pair of continuous toothed belts 8 of FIG. 4, are replaced by a single continuous belt 48, and the bell crank element 26 is replaced by a pair of arms 46. Each arm 46 is arranged at either side of belts 48. In place of the pairs of pusher elements 19 of FIG. 4, longer bars 49 may be provided having ends projecting from the side edges of the belt 48 to act on arms 46. As shown in the embodiment of FIG. 6 means, such as hydraulic or pneumatic jacks 44 synchronized with and/or controlled by said belts 8, may be used for causing the oscillating movements of the bell-crank elements 26. Each hydraulic jack 44 is controlled through a drive unit 41 by a pusher element position detector device 42. The conveyor means, in the embodiment, of FIG. 2, comprises a pair of toothed belts 8, but could also be of any other type, including the single continuous belt 48 shown in FIG. 5.

What I claim is:

1. In an apparatus for feeding folded and flattened cartons to a packaging machine, a combination comprising:

a continuous path formed of a first rising section, a junction zone, and a second substantially horizontal section associated with its end portion opposite to said junction zone with a packaging line for said packaging machine;

conveyor means movable in a single direction along said continuous path;

pusher means carried by said conveyor means;

a magazine for holding said folded and flattened cartons and overlying said rising section, said magazine having an upper loading opening and a lower outlet opening;

movable supporting means for the cartons at said junction zone between said first and second sections of the path; and actuating means synchronized with said conveyor means for oscillating said supporting means between a first position arranged in continuation of said first rising section and a second position, where they are arranged substantially coplanar and parallel to said conveyor means along said second substantially horizontal section.

2. A combination as defined in claim 1, wherein said movable supporting means has a shaft located at a lower level than that of said junction zone.

3. A combination as defined in claim 2, wherein said movable supporting means comprises at least one arm extending from said junction zone in the same advancement direction of said conveyor means.

4. A combination as defined in claim 3, wherein at said junction zone said at least one arm has a curved length with its center of curvature on the axis of the shaft of said supporting means.

5. A combination as defined in claim 4, wherein the spacing between said shaft and the upper surface of said at least one arm substantially corresponds to the spacing between said shaft and the upper surface of said conveyor means.

6. A combination as defined in claim 1, wherein said conveyor means comprises a single continuous element, said movable supporting means comprising a pair of arms arranged at the two sides of said single continuous element.

7. A combination as defined in claim 1, wherein said conveyor means comprises a plurality of parallel continuous elements and said movable supporting means comprises a plurality of pairs of arms, the arms of each pair being arranged at the two sides of a corresponding parallel continuous element of said plurality.

8. A combination as defined in claim 1, wherein said actuating means for said supporting means comprises pusher elements integral with said conveyor means and engageable with the same supporting means.

9. A combination as defined in claim 1, wherein said actuating means for said supporting means comprises at least one pneumatic jack synchronized with said conveyor means.

10. A combination as defined in claim 1, wherein said actuating means for said supporting means comprises at least one hydraulic jack synchronized with said conveyor means.

* * * * *